US007051727B2

(12) United States Patent
Wu

(10) Patent No.: US 7,051,727 B2
(45) Date of Patent: May 30, 2006

(54) SHOOTING MECHANISM OF SHOT REPEATER TARGET TOY

(76) Inventor: Wen-Long Wu, No. 5, Alley 26, Lane 62, Tung-Hsing Rd., Ta-Li City, Taichung Hsien (TW)

( * ) Notice: Subject to any disclaimer, the term of this patent is extended or adjusted under 35 U.S.C. 154(b) by 27 days.

(21) Appl. No.: 10/971,014

(22) Filed: Oct. 25, 2004

(65) Prior Publication Data

US 2006/0086345 A1 Apr. 27, 2006

(51) Int. Cl.
*F41B 4/00* (2006.01)

(52) U.S. Cl. ..... 124/6

(58) Field of Classification Search ..... 124/1, 124/6, 8, 21, 40, 78, 82
See application file for complete search history.

(56) References Cited

U.S. PATENT DOCUMENTS

| | | | | |
|---|---|---|---|---|
| 3,717,136 | A * | 2/1973 | Gay et al. | 124/21 |
| 5,050,575 | A * | 9/1991 | Killion | 124/8 |
| 5,611,322 | A * | 3/1997 | Matsuzaki et al. | 124/6 |
| 5,782,228 | A * | 7/1998 | Wu | 124/6 |
| 6,116,229 | A * | 9/2000 | Wu | 124/6 |
| 6,758,203 | B1 * | 7/2004 | Wu | 124/6 |

* cited by examiner

*Primary Examiner*—John A. Ricci
(74) *Attorney, Agent, or Firm*—Birch, Stewart, Kolasch & Birch, LLP

(57) ABSTRACT

The present invention discloses a shooting mechanism of a shot repeater toy, such as an L-shape gun body, comprising a target platform disposed on one side, a trigger disposed on another side of a handle and a magazine disposed at the bottom of the target platform for shooting bullets in succession. Pulling the trigger can start a poking unit in the target platform to successively shoot bullets, and thus constituting a toy gun for shooting bullets in succession.

7 Claims, 10 Drawing Sheets

SHOOTING MECHANISM OF SHOT REPEATER TARGET TOY

FIELD OF THE INVENTION

The present invention relates to a toy gun, more particularly to a shot repeater target toy mechanism capable of shooting bullets in rapid succession.

BACKGROUND OF THE INVENTION

Please refer to FIGS. 1 and 2A respectively for the perspective view and the illustrative view of a prior-art handheld safe disc shooting toy that comprises a component body 10, a feeder opening 14 disposed on a component platform 11, a feeding device 20 disposed under the feeder opening 14 for flexibly stacking a plurality of circular disks 30 one on top of the other, a servomotor 60 disposed on a side of the feeder opening 14 for driving a transversal ratcheted disk 61 to rotate, and a circular disk pushing device 50 disposed at the back of the feeder opening 14 of the component platform 11. The circular disk pushing device 50 further comprises a trigger 51 pivotally connected to a handle 12, and one end of the trigger 51 is pivotally connected to the bottom of a link rod 52, and the middle of the link rod 52 is pulled by a resilient spring 521. The rear end of a push rod 53 is movably connected to the link rod 52 and pushed by the link rod 52 to prop the front end from the feeder opening 14 as shown in FIG. 2B. Once the trigger 51 is pulled by a user's finger, the bottom of the link rod 52 is pushed backward by the trigger 51 and the spring 521 is pulled and stretched, and the top of the link rod 52 drives the push rod 53. The front end 53 of the push rod 53 props the uppermost circular disk 30 to engage the circular disk 30 with the rotating ratcheted disk 61. With a high speed of the fast turning ratcheted disk 61, the circular disk 30 is shot. From the description of the foregoing mechanism, it is necessary to pull the trigger 51 only once to push out a circular disk 30 and shoot the circular disk 30, but such arrangement cannot achieve the purpose of shooting in succession.

SUMMARY OF THE INVENTION

Therefore, the primary objective of the present invention is to provide a shooting mechanism of shot repeater target toy, which comprises a gun body, a target platform disposed on one side of the gun body, a magazine disposed at the bottom of the target platform for containing a plurality of bullets and a shooting mechanism installed at a side of the target platform, characterized in that a continuous revolving poking unit pushes the bullets one by one towards the shooting mechanism to achieve the effect of shooting bullets in succession.

To make it easier for our examiner to understand the objective of the invention, its structure, innovative features, and performance, we use a preferred embodiment and the attached drawings for the detailed description of the invention.

DETAILED DESCRIPTION OF THE PREFERRED EMBODIMENTS

Figure 1:
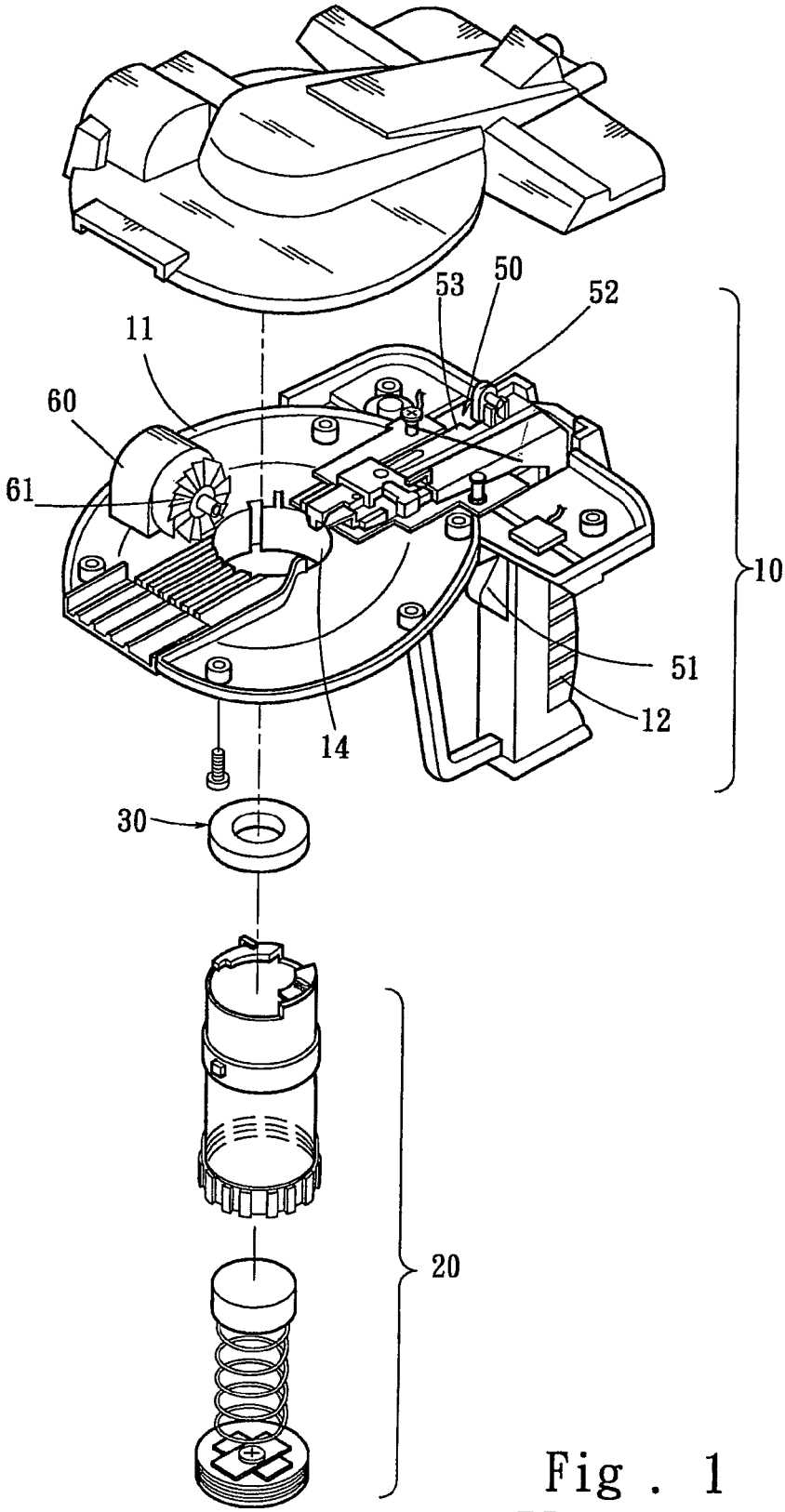
Fig. 1 PRIOR ART
FIG. 1 is an exploded view of a prior-art shot repeater target toy.
Figure 2A:
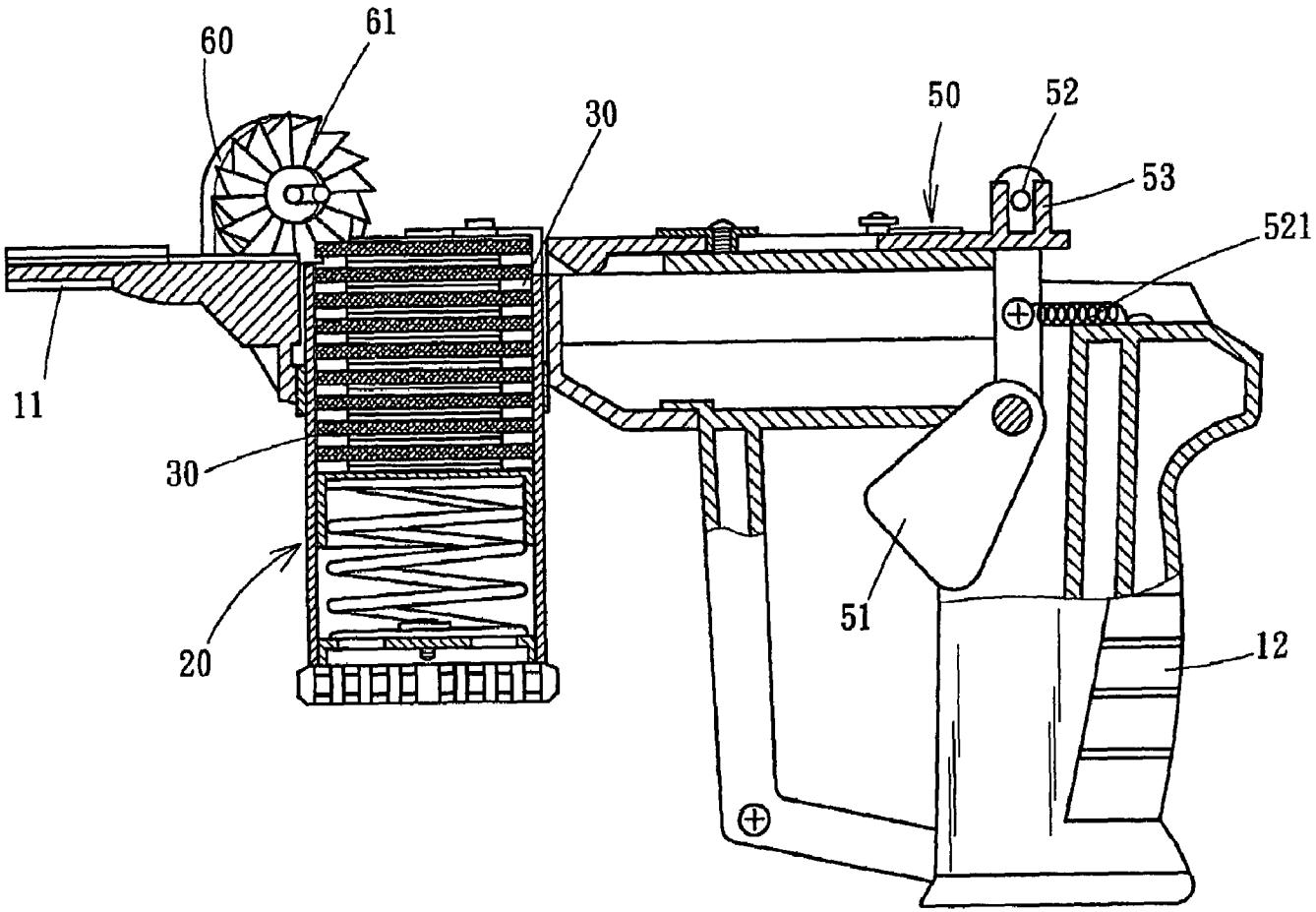
Fig. 2A PRIOR ART
FIG. 2A is an illustrative view of a prior-art shot repeater target toy.
Figure 2B:
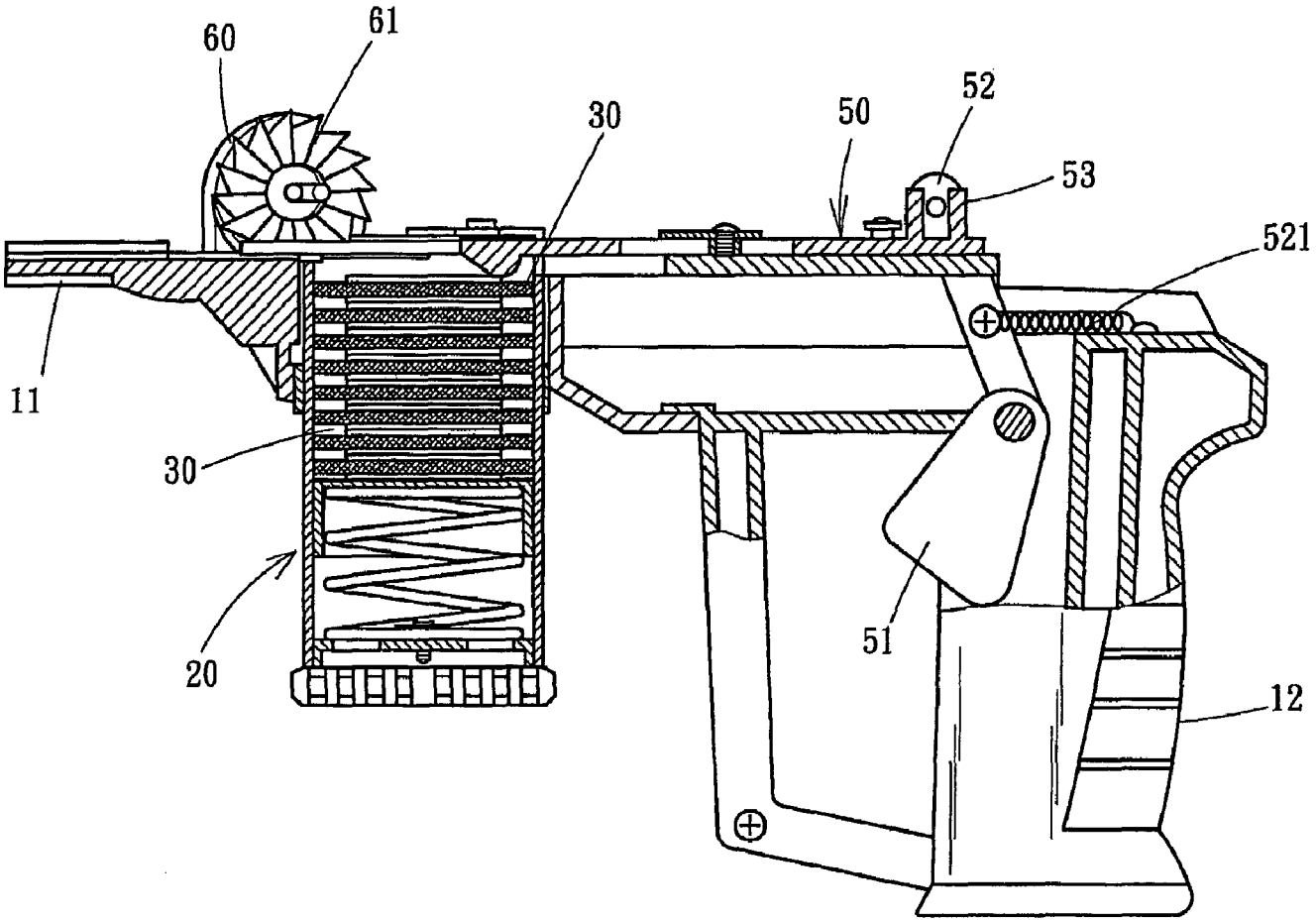
Fig. 2B PRIOR ART
FIG. 2B is an illustrative view of the movements as depicted in FIG. 2A.
Figure 3:
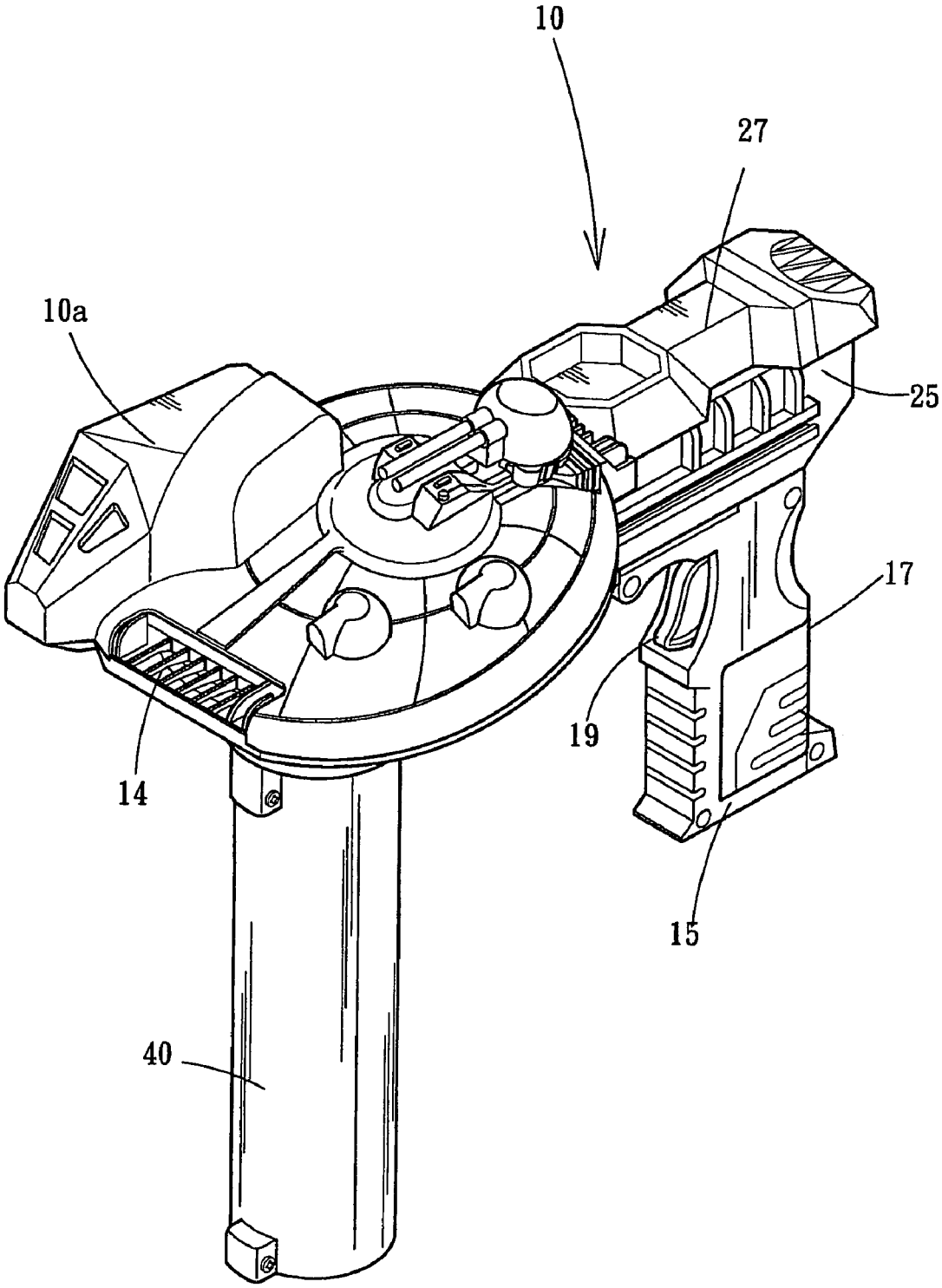
FIG. 3 is a perspective view of the shooting mechanism of a shot repeater target toy according to a preferred embodiment of the present invention.
Figure 4:
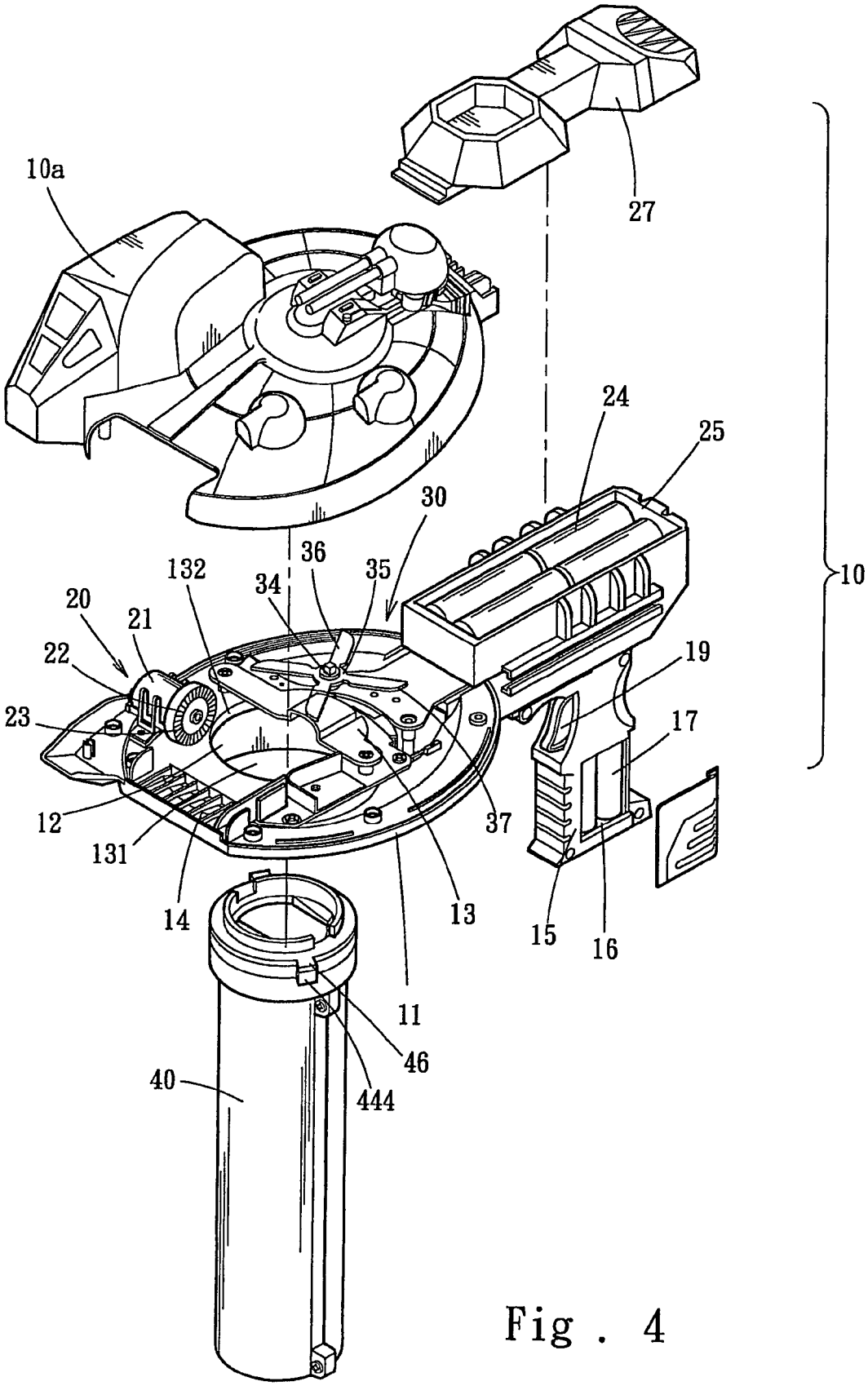
FIG. 4 is an exploded view of the shooting mechanism of a shot repeater target toy according to a preferred embodiment of the present invention.
Figure 5A:
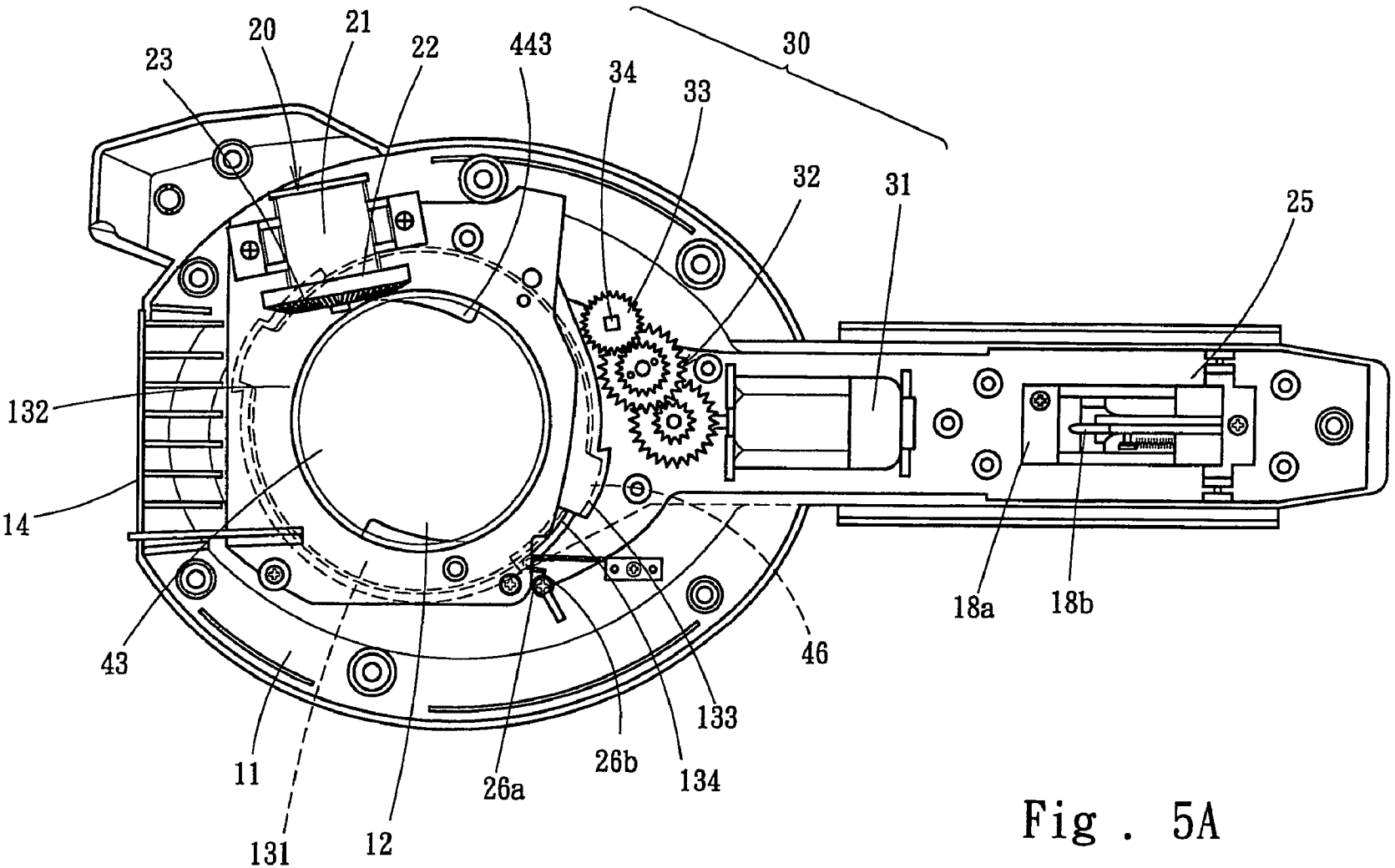
FIG. 5A is a top view of the target platform of the present invention.
Figure 6A:
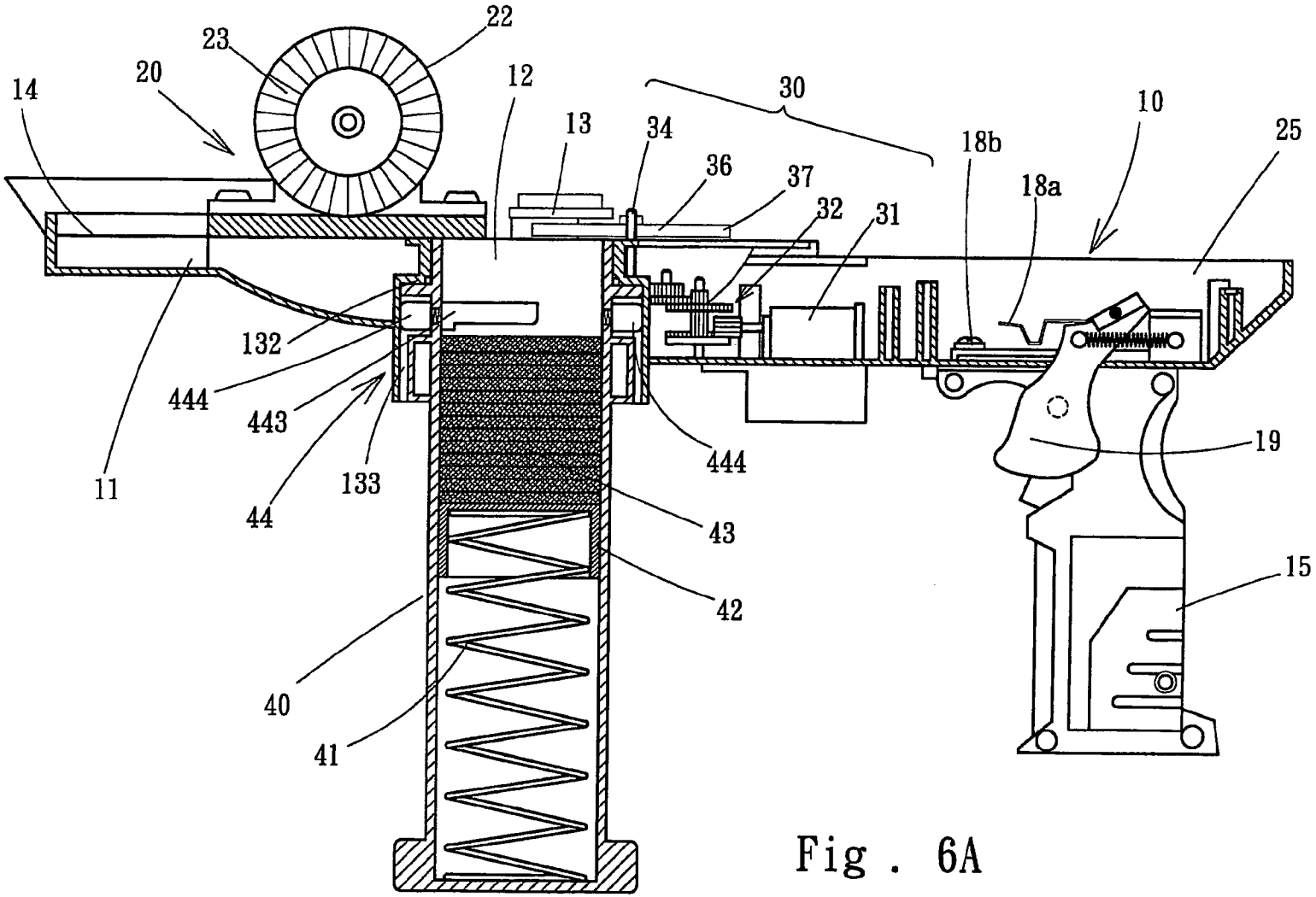
FIG. 6A is a cross-sectional view of the present invention.

Please refer to FIGS. 3 and 4 for a shooting mechanism of repeater target toy according to the present invention, which comprises an L-shape gun body 10 having a disk-shape target platform 11 disposed on a side of the gun body 10, a bullet outlet 12 being penetrating vertically and disposed at the center of the target platform 11, a limit plate 13 transversally disposed across the top of the bullet outlet 12, a circular sheathing ring 131 having an external diameter larger than the external diameter of the bullet outlet 12 to define a stop edge 132, two sliding grooves 133 disposed on the corresponding walls of the sheathing ring 131 as shown in FIG. 5A, a latch groove 134 extended towards one side of the sliding groove 133, a shooting outlet 14 disposed on the front side of the gun body 10, a handle extended downward from another side of the target platform 11, a second power supply 17 (such as two batteries) being accommodated in a chamber 16 at the bottom of the second power supply and connected to an electrically conductive plate 18*a* by a circuit as shown in FIG. 6A, a trigger 19 having its middle section pivotally disposed on the handle 15 and partially exposed from the internal side of the handle 15 for allowing a user's finger to flexibly press on the trigger 19, another electrically conductive plate 18*b* being disposed on the top of the trigger 19 and secured in a compartment 25 disposed at the top of the handle 15, and an upper chassis 10*a* covering the top of the target platform 11.

The present invention also comprises a shooting mechanism 20 disposed on a side of the target platform 11, and the shooting mechanism 20 comprises a first drive source 21 (such as a motor), a circular turning disk 22 pivotally coupled to the transversal center rod, and a surface of the external diameter of the turning disk 22 corresponding to one side of the bullet outlet 12, a plurality frictional raised lines 23 being arranged in a circular shape, and the first drive source 21 being connected to a first power supply 24 (such as a plurality of batteries) and the first power supply 24 being disposed inside the compartment 25 at one side of the top surface of the gun body 10 and latched by a chassis 27, and the first power supply 24 being connected to an electrically conductive plate 26*a* as shown in FIG. 5A, and the electrically conductive plate 26*a* being disposed on the target platform 11, and one end of another electrically conductive plate 26*b* being disposed on the opposite side of the electrically conductive plate 26*a*, and the other end being a movable end for being poked.

The invention further comprises a poking unit 30 disposed at the rear side of the bullet outlet 12 of the target platform 11. Please refer to FIGS. 4, 5A and 6A. The poking unit 30 further comprises a second drive source 31 (such as a motor) electrically connected to the electrically conductive plate 18*b* of the trigger 19 by a circuit and the second drive source 31 driving a poking gear 33 to turn through the transmission of gear set 32, a turning member 35 being disposed at the top of a center axle of the poking gear 33 and arranged in a circular shape of 4 rotary vanes 36 under the limit plate 13 of the target platform 11, a poking end 37 being curvedly disposed on one side of an end of each rotary vane and extended to the position of the bullet outlet 12, and the second drive source 31 being driven by a second power supply 17.

Figure 7B:
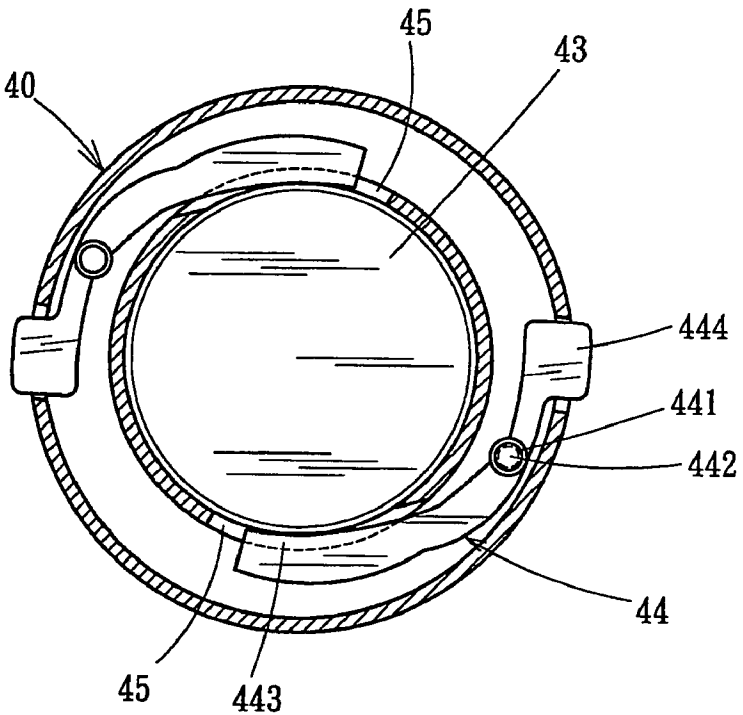
FIG. 7B is an illustrative view of the movements as depicted in FIG. 7A.
Figure 7A:
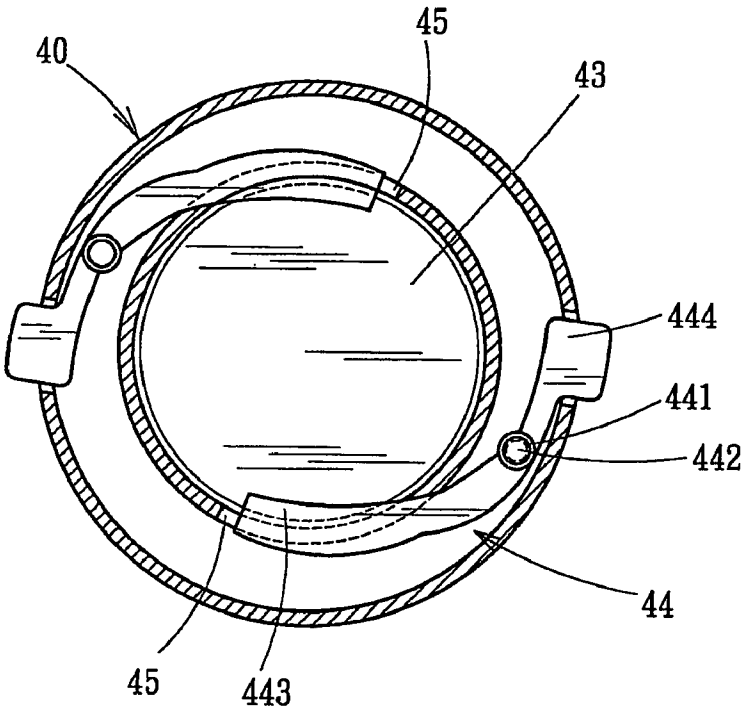
FIG. 7A is a transversal cross-sectional view of the target barrel of the present invention.

The invention further comprises a magazine 40 being a cylinder and having an external diameter of its top larger than that of its bottom to match the size of the sheathing ring 131 of the target platform, an axial resilient spring 41 being disposed at the bottom of a hollow internal side as shown in FIG. 6A, a pushing member 42 being coupled to the top of the spring 41, a plurality plastic circular bullets 43 being stacked inside the magazine 40, and the bullet 43 at the bottom being propped by the pushing member 42, two control members 44 as shown in FIG. 7A being pivotally coupled to the periphery of the top of the magazine and turned, a pivotal hole 441 disposed at the middle of the control member 44 for pivotally connecting a pin 442 into the walls of the magazine 40 along an axial direction, a stop section 443 being disposed at one end of the internal side of the control member 44 and exposed from a through hole 45 at the internal wall of the magazine 40, a control section 444 outwardly protruded from another end of the control member 44, a chunk-shape limit position section 46 being outwardly protruded from the wall of the magazine at the top of the control section 444, and the limit position section 46 being sheathed into the corresponding sliding groove 133 of the target platform 11, and the top of the magazine 40 being coupled to a stop edge 132 of the sheathing ring 131 at the bottom of the target platform 11, and a bullet 43 being pushed out from the bullet outlet 12.

Figure 5B:
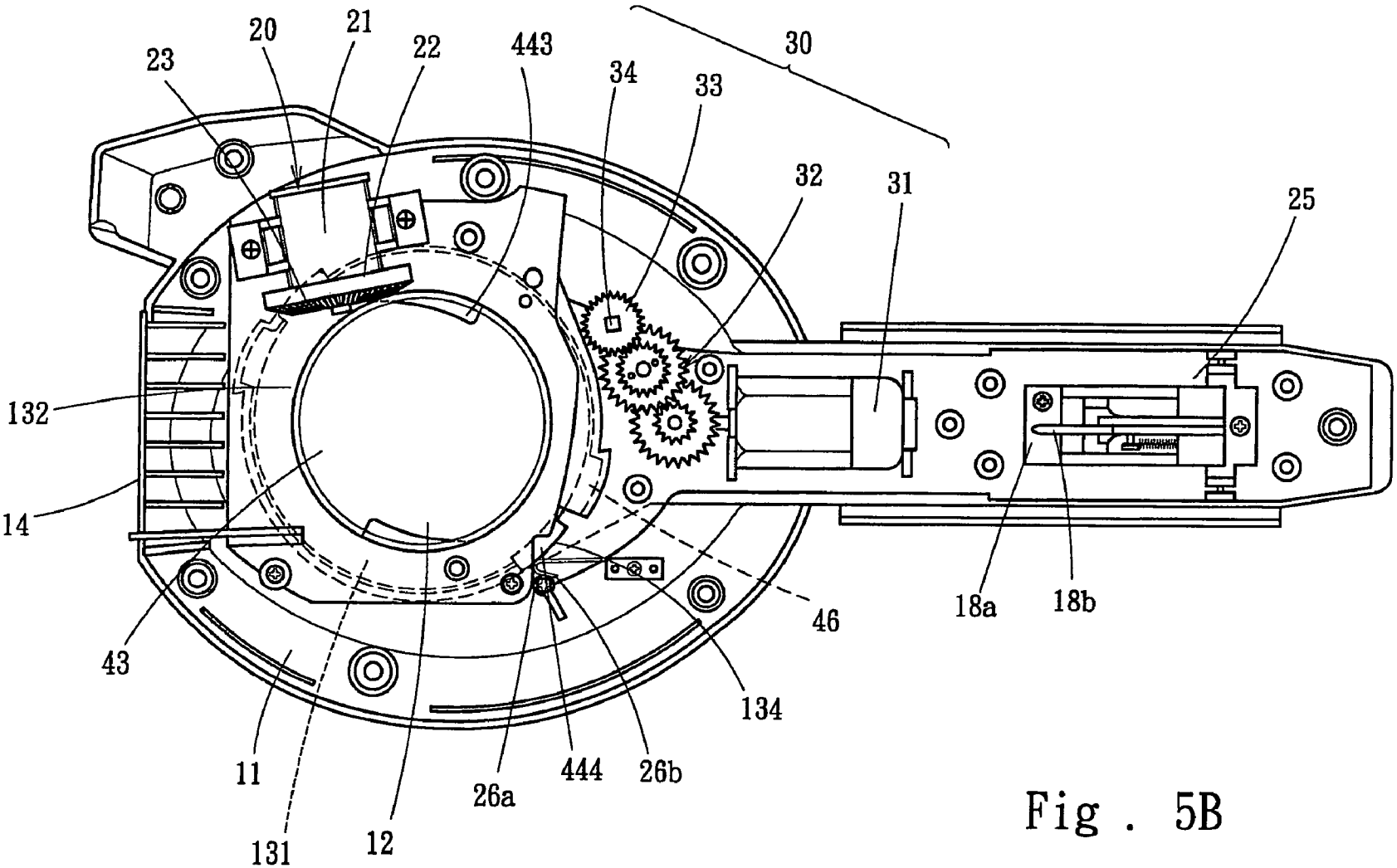
FIG. 5B is an illustrative view of the movements as depicted in FIG. 5A.
Figure 6B:
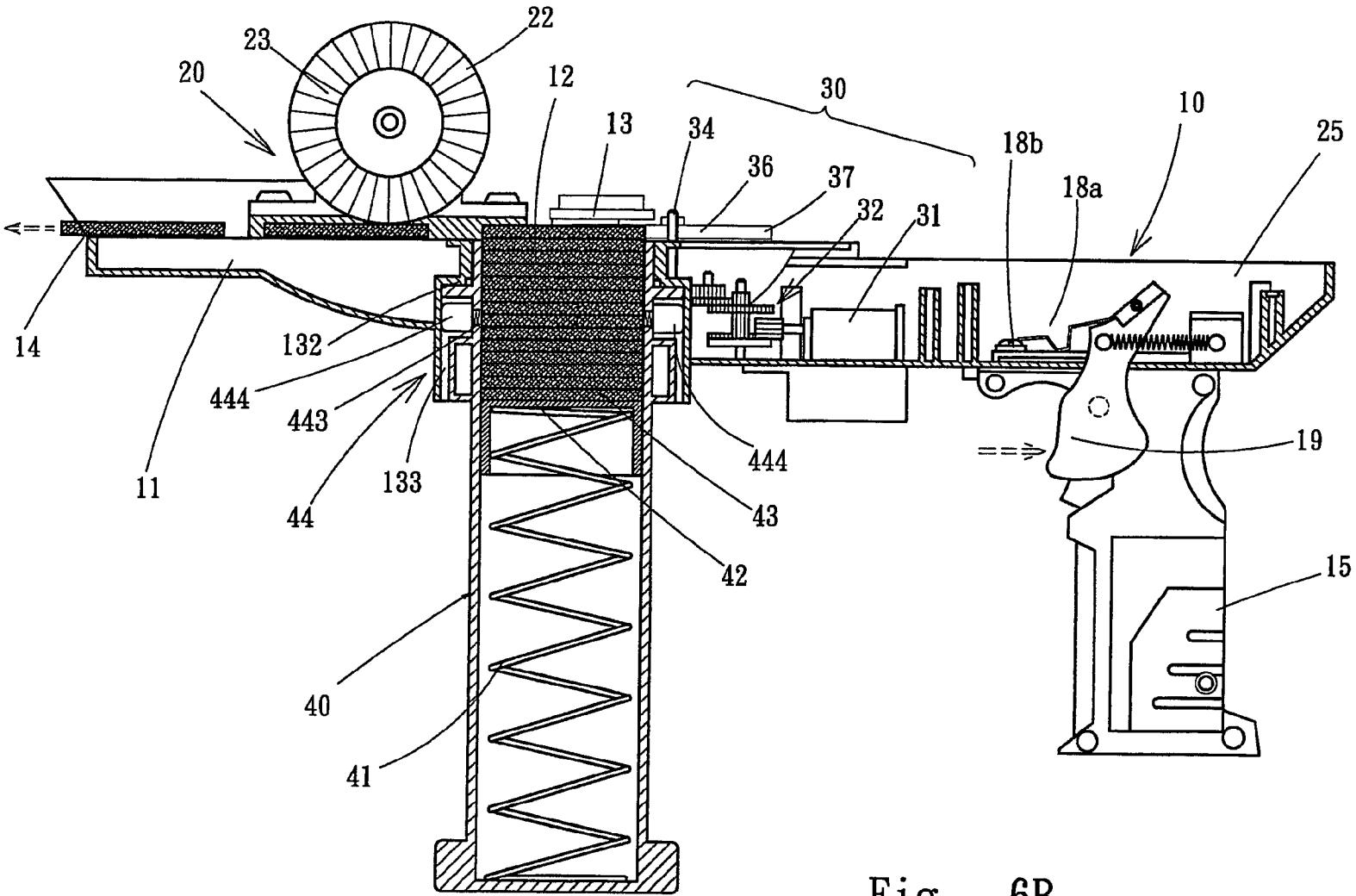
FIG. 6B is an illustrative view of the movements as depicted in FIG. 6A.

By means of the foregoing structure, the magazine 40 is upwardly loaded into the sheathing ring 131 at the bottom of the target platform 11 when the shooting mechanism is used, and the magazine 40 is turned to an angle as shown in FIGS. 5A and 5B, such that the two limit position sections 46 are sheathed into a latch groove 134 at one side of the sheathing ring 131 and secured into a fixed position. Then, the limit position section 46 on one side of the magazine 40 simultaneously pushes the electrically conductive plate 26*b* and the electrically conductive plate 26*a* to electrically connect with each other, and the two control sections 444 of the magazine 40 are compressed and withdrawn into the wall surface of the top of the sheathing ring 131 as shown in FIG. 7B, so that the two stop sections 443 move outward, and the uppermost bullet 43 losses its suppression and props upward. In the meantime, the first drive source 21 is driven to start turning the turning disk 22. The trigger 19 is pulled to electrically connect the electrically conductive plate 18*a* with the electrically conductive plate 18*b* as shown in FIG. 6B, so that the second drive source 31 starts driving the poking gear 33 to rotate, and the turning member 35 pivotally coupled to the top of the axle 34 to rotate. Therefore, a bullet 43 located at the bullet outlet 12 is popped immediately. The circular bullet is clipped by the turning disk 22 of the shooting mechanism 20, and thus the bullet 43 is shot at a specific speed by the fast turning disk 22.

It is noteworthy that when the first bullet 43 is shot, the second bullet 43 will be propped up by the spring 41 and limited by the limit plate 13 at the top of the bullet outlet 12. The continuously revolving turning member 35 will poke the second bullet 43 by the poking end 37 of a rotary vane 36, such that the second bullet 43 will be clipped by the turning disk 22. With the frictional raised lines 23 of the turning disk 22, the bullet 43 is projected outward by a fast turning speed of the turning disk 22 to achieve the purpose of shooting bullets 43 in succession.

What is claimed is:

1. A shooting mechanism of shot repeater target toy, comprising:

a gun body, having a disk-shape target platform;

a bullet outlet, being vertically penetrating and disposed on said target platform;

a limit plate, being disposed at the top of said bullet outlet;

a sheathing ring, being disposed at the bottom of said bullet outlet and having a size larger than said bullet outlet;

two sliding grooves, being disposed along an axial direction of the wall of said sheathing ring;

a latch groove, being extended from one side of said each sliding groove;

a handle, being extended downward from another side of said target platform;

a trigger, being pivotally coupled to a handle, and one end of said trigger being pressed to electrically couple an electrically conductive plate with another electrically conductive plate as to electrically couple a first power supply;

a shooting mechanism, including a first drive source, and said first drive source having a transversal center rod coupled to a turning disk, and said turning disk being disposed on one side of said target platform, and said first drive source being started by electrically coupling a second power supply;

a poking unit, being disposed at the rear side of said bullet outlet and including a second drive source for coupling and controlling said trigger, and said second drive source driving an axle to rotate, and being driven by said second power supply;

a turning member, being disposed on the top of said axle and under said limit plate of said target platform and having a plurality of rotary vanes;

a magazine, being cylindrical in shape and sheathed into said sheathing ring and including a plurality of disk bullets stacked inside said magazine;

a spring, for propping a bottom bullet upward;

two control units, being pivotally coupled to the wall at the top of said magazine and capable of turning around;

a stop section, being disposed at one end of said control unit;

a through hole, being disposed at and exposed from an internal wall of said magazine for blocking an uppermost bullet; and a control section, being protruded from the external side of another end, and withdrawn when being pressed.

2. The shooting mechanism of shot repeater target toy of claim 1, wherein said target platform comprises a compartment disposed at one side of the top of said target platform for containing a first power supply, and a second power supply being contained in a chamber below said handle.

3. The shooting mechanism of shot repeater target toy of claim 1, wherein said second drive source is coupled to a gear set for retarding, and said gear set is engaged with a poking gear such that said axle at the center of said poking gear drives said turning member to rotate, and one side of the end of said rotary vane of said turning member is designed in a curved poking end, and said bullet is circular in shape and made by a rubber material.

4. The shooting mechanism of shot repeater target toy of claim 1, wherein said turning disk of said shooting mechanism comprises a plurality of frictional raised lines disposed around the external circumference of said turning disk.

5. The shooting mechanism of shot repeater target toy of claim 1, wherein said target platform includes an upper chassis thereon.

6. The shooting mechanism of shot repeater target toy of claim 1, wherein said first power supply and said second power supply are batteries.

7. The shooting mechanism of shot repeater target toy of claim 1, wherein said magazine has an external diameter at the top larger than an external diameter at the bottom to facilitate sheathing said sheathing ring of said target platform, and a limit section in a chunk shape is protruded from a position corresponding to the top of said magazine, and said latch groove at the top of said sliding groove of said sheathing ring is provided for sheathing and rotating said limit section into a fixed position, and said control section at the external side of said control member presses against said electrically conductive plate, so that said electrically conductive plate is in contact with another electrically conductive plate to start said first drive source.

* * * * *